US005769620A

United States Patent [19]

Briem

[11] Patent Number: 5,769,620

[45] Date of Patent: Jun. 23, 1998

[54] PERCUSSION MECHANISM FOR A TOOL WORKING BY PERCUSSION OR ROTARY PERCUSSION

[76] Inventor: Rolf Briem, Morikestr. 86, 71636 Ludwigsburg, Germany

[21] Appl. No.: 341,565

[22] PCT Filed: May 13, 1993

[86] PCT No.: PCT/EP93/01193

§ 371 Date: Nov. 15, 1994

§ 102(e) Date: Nov. 15, 1994

[87] PCT Pub. No.: WO93/23211

PCT Pub. Date: Nov. 25, 1993

[30] Foreign Application Priority Data

May 15, 1992 [DE] Germany ..... 42 16 071.5

[51] Int. Cl.[6] ..... F01C 1/00

[52] U.S. Cl. ..... 418/164; 418/1; 173/1

[58] Field of Search ..... 418/61.2, 164, 418/1; 173/1

[56] References Cited

U.S. PATENT DOCUMENTS

| | | | |
|---|---|---|---|
| 4,946,355 | 8/1990 | Old et al. | 418/164 |
| 5,174,388 | 12/1992 | Williams et al. | 173/1 |

FOREIGN PATENT DOCUMENTS

| | | | |
|---|---|---|---|
| 302908 | 8/1915 | Germany . | |
| 8687 | 5/1956 | Germany | 418/164 |
| 3405922 A1 | 8/1985 | Germany . | |
| 3427342 A1 | 1/1986 | Germany . | |
| 4216071 C2 | 3/1994 | Germany . | |

*Primary Examiner*—Charles G. Freay

[57] ABSTRACT

In a rotary compressor unit an inner and an outer rotor turn in an intermeshed rotation, a compression space and a suction space being formed alternately on radially offset sides of the inner rotor. A piston moves axially back and forth within a hollow space of the inner rotor. The inner rotor has a hollow space which has front and rear control channels which are alternately connected to the compression and suction spaces to drive the piston back and forth. The piston is used to actuate a percussion tool.

20 Claims, 5 Drawing Sheets

PERCUSSION MECHANISM FOR A TOOL WORKING BY PERCUSSION OR ROTARY PERCUSSION

Figure 1:
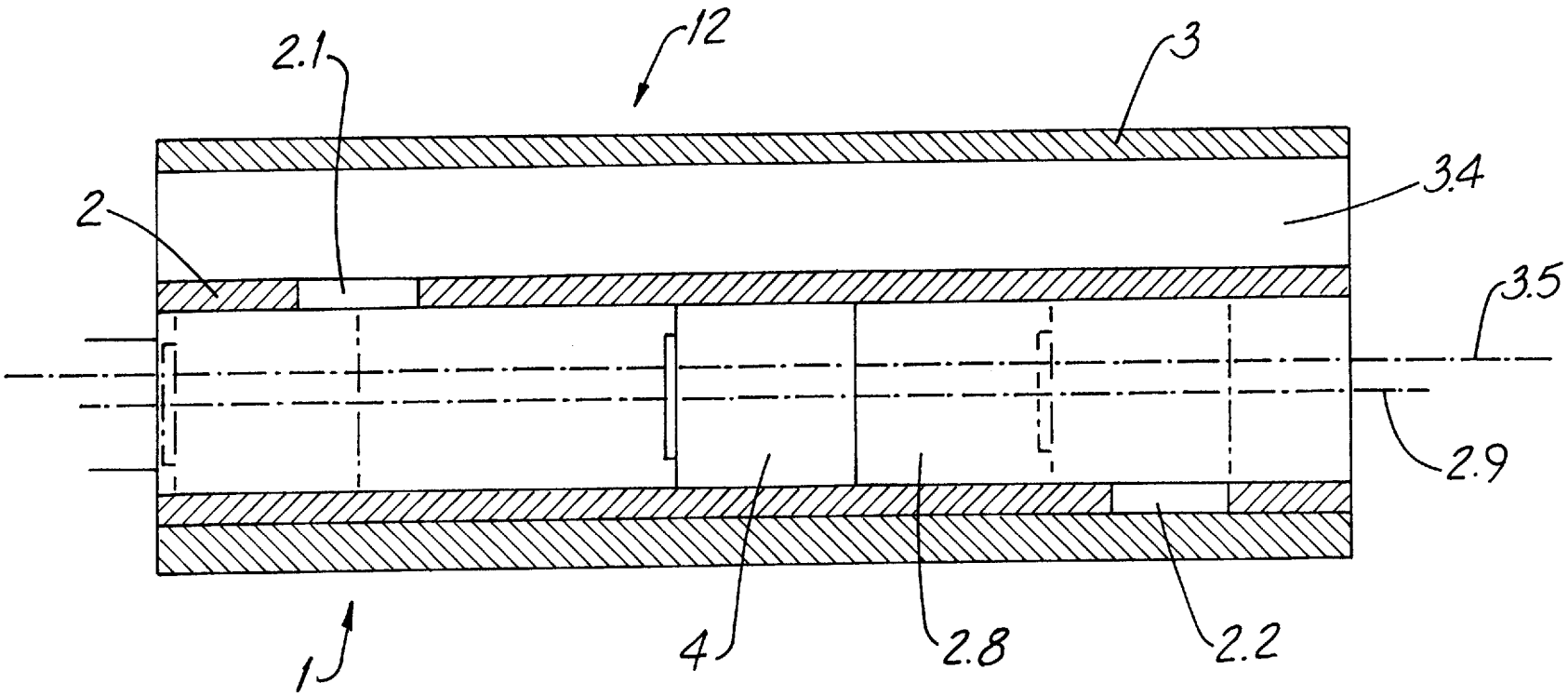

This application is the national stage of PCT application PCT/EP 93/01193 filed May 13, 1993, published as WO93/23211 Nov. 25, 1993.

The invention relates to a method for actuating a percussion drilling tool and to a percussion mechanism for a tool working by percussion or rotary percussion.

A method and percussion mechanism of this type is described in Charcut, W.: Drucklufthandbuch [Compressed-Air Manual] 2nd Edition, Vulkan-Verlag Essen, 1979, pages 246 to 247, ISBN 3-8027-2647-2. For the reciprocating movement of the percussion piston, the compressed air must be fed into and discharged from the cyclinder spaces upstream and downstream of the piston by travel-dependent control. This control is possible, in principle, in two different ways: namely, via a self-controlling percussion piston, the lifting movement of the percussion piston being controlled by the air feed and air discharge, in that the piston opens and closes the air-feeding and air-discharging control channels, or via a valve body. Valveless percussion mechanisms are considered advantageous on account of the simple design and robust construction, but the impact energy is low, since the floating piston is required for opening and closing the control channels and can therefore execute only a small stroke, so that the piston speed achieved is low, as is consequently the impact energy which is proportional to the square of the speed. The publication states expressly that an increase in the piston travel is possible only if the control of the compressed-air feed is transferred to special control members.

A further conventional method and percussion mechanism of this type is based on the principle that a percussion or floating piston for driving a drilling tool or chisel is set in reciprocating movement by means of a pressure piston moved reciprocatingly in a cavity and designed as a lifting piston. Such percussion hammers are known especially as electropneumatic percussion hammers. The electric motor actuates the pressure piston via a bevel-wheel set or a pendulum ballbearing, with the result that considerable vibrations occur in the percussion hammer.

A percussion drilling machine, in which a cylinder space guiding the percussion piston is alternately loaded by a pressure medium on different of the percussion piston, in order to generate the reciprocating movement, is described in DE 3,439,268 A1. For this purpose, channels extending from a pressuremedium source are opened and closed in a controlled manner by means of valves.

The object on which the invention i s bas ed is to provide a method for actuating a percussion drilling tool or chisel and a valveless percussion mechanism for a tool working by percussion or rotary percussion, by means of which a high percussion energy can be achieved.

This object is achieved by means of the features specified in claims 1 and 5 respectively.

These measures ensure that, without separate control valves and without the intermediary of the floating piston, the compressed air is fed and discharged solely as a result of the rotation of the inner rotor and outer rotor, in order to move the floating piston. As a result, the floating travel can be increased considerably and varied within wide limits in comparison with conventional valveless percussion mechanisms. As a result of the relatively large stroke of the floating piston, a high percussion energy can be achieved even in the case of a relatively light floating piston.

Advantageous embodiments of the method and of the percussion mechanism in terms of construction and mode of operation are the subject of the subclaims.

To transmit the energy of the floating piston to tool, provision can be made, for example, for there to be a percussion pin, to which a percussion or rotary-percussion tool can be coupled and which is guided axially displaceably in a percussion-pin guide provided on the front end face of the inner rotor, and for the percussion pin to be aligned axially with the floating piston and to be actuable by the latter.

In a hammer drill which uses the percussion mechanism and the method, provision is made for there to be a percussion pin which is rotatable by means of a drive and to which a drilling tool can be coupled and which is guided axially displaceably in a percussion-pin guide provided on the front end face of the inner rotor, and for the percussion pin to be aligned axially with the floating piston and to be actuable by the latter.

A percussion chiseler based on this apparatus and on the method is defined in that there is provided a percussion pin, into which a chisel can be inserted and which is guided axially displaceably in a percussion-pin guide provided on the front end face of the inner rotor, and in that the percussion pin is aligned axially with the floating piston and is actuable by the latter.

The rotary-piston compressor principle presented here is known especially from the comprehensive work done by Wankel who proposed various types and forms of rotary-piston compressors. Now according to the invention, this principle is modified, so that it is suitable for generating the lifting movement of the floating piston, with the result that not only a simple design and drive, but also a largely vibration-damped suspension of the drive motor is possible, whilst a bevel-wheel set which is complicated to adjust or a pendulum ballbearing becomes unnecessary, for example in comparison with conventional hammer drills. Furthermore, the design made possible, with few components and a favorable arrangement of these, allows simple assembly along with small dimensions and a low weight. The floating length of the floating piston is not tied to the stroke length of a crank mechanism.

In a special embodiment, the ratio of rotational speed between the inner and outer rotor is 1:2, and the compression space and suction space are formed on diametrically opposite part faces of the outer circumference of the inner rotor.

As is known per se, in the various embodiments, provision can be made, when the floating piston assumes its front end position confronting the tool to be actuated, for the compressed air to flow freely through the cavity between the first and the second control channels, thereby avoiding an idle impact, and for the movement of the floating piston to be activated by pushing it into the cavity between the first and the further control channels as a result of the pushing in of the tool to be actuated.

A further advantage is that, during the return of the floating piston, an air cushion, by which the impact is damped, can be formed downstream of the further, that is to say rear control channels, as is likewise known per se.

A favorable form of the inner rotor is such that the outer contour of the inner-rotor cross-section is symmetrical relative to its small and large outside diameter and consists of two segments of a circle, the radius of curvature of which corresponds approximately to the larger radius of curvature of the elliptic inner space which is based on the type DKM 53 of Wankel. Various designs provide for the cavity of the inner rotor and of the floating piston to be cylindrical, for the outer circumference of the outer rotor to be circular, for the electric motor used for generating the rotational movement to be arranged parallel to the inner and outer rotor, and for the drive to take place via belt pulleys and belts, especially toothed belts or V-rib belts, or via gear wheels.

In the hammer drill using the principle of the rotary-piston compression unit described, for example the percussion pin is held in a drilling shaft driven in rotation. The drilling shaft can likewise be driven via a belt pulley and a belt or via gear wheels by means of the electric motor.

Figure 2:
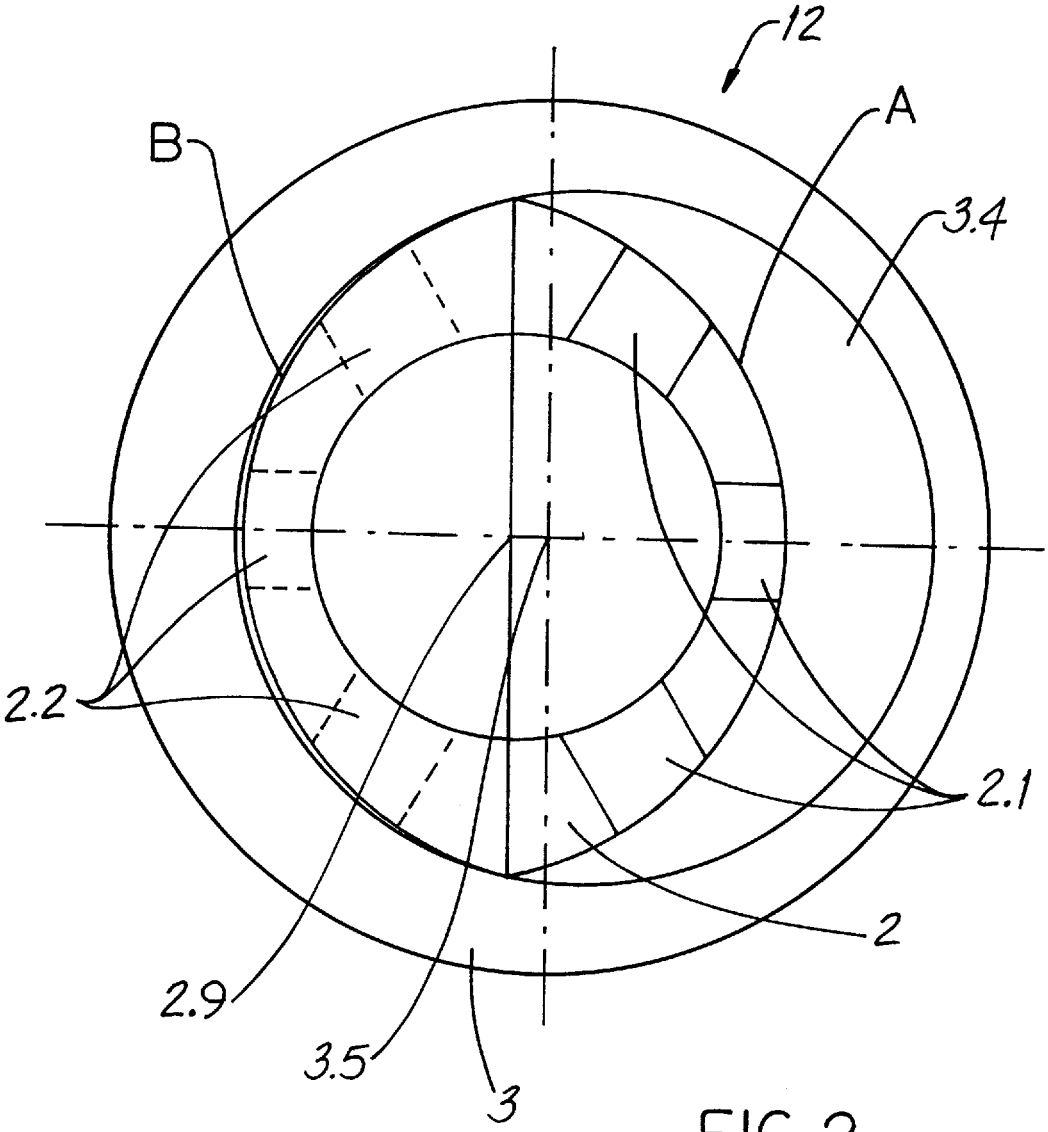
Figure 3A:
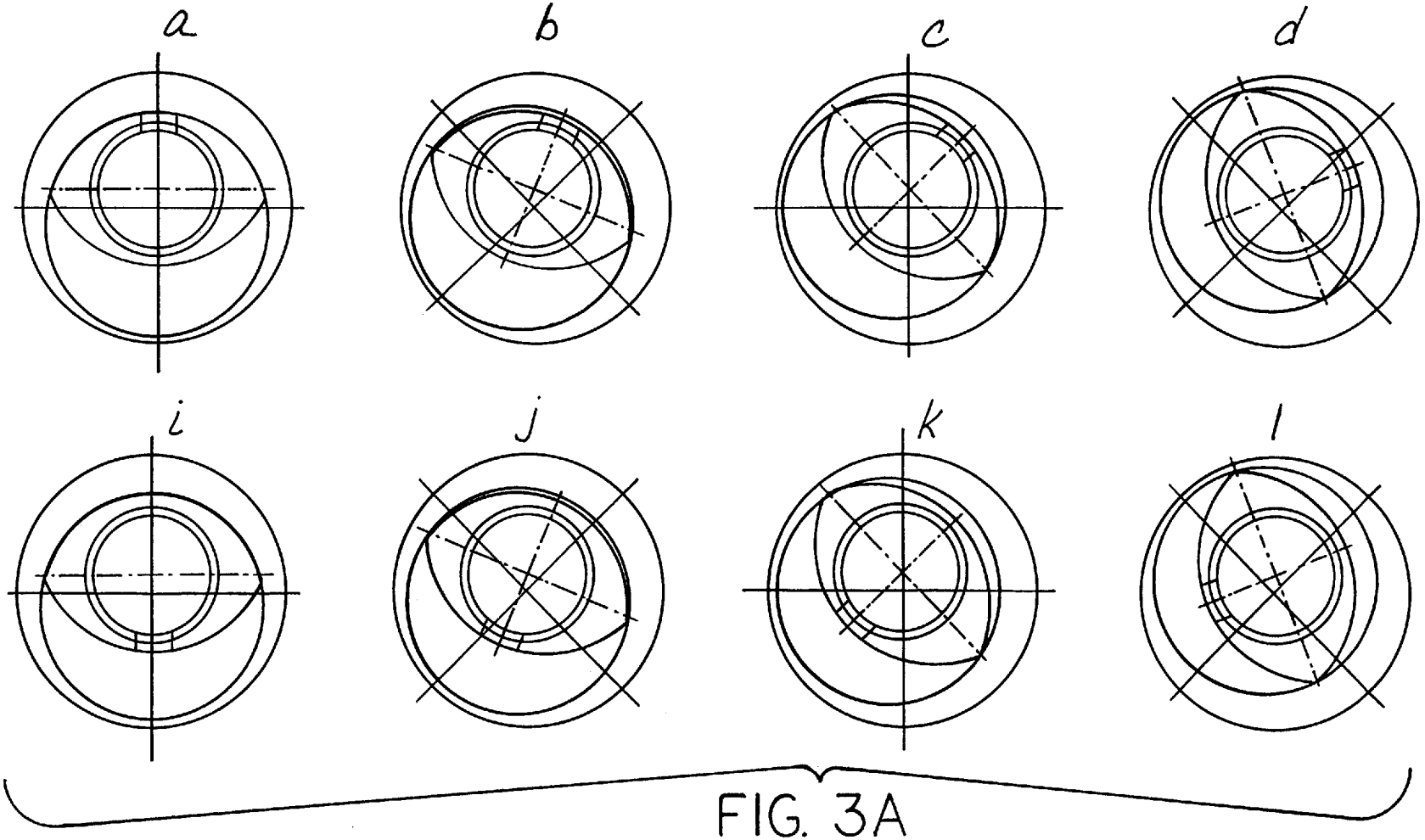
Figure 3B:
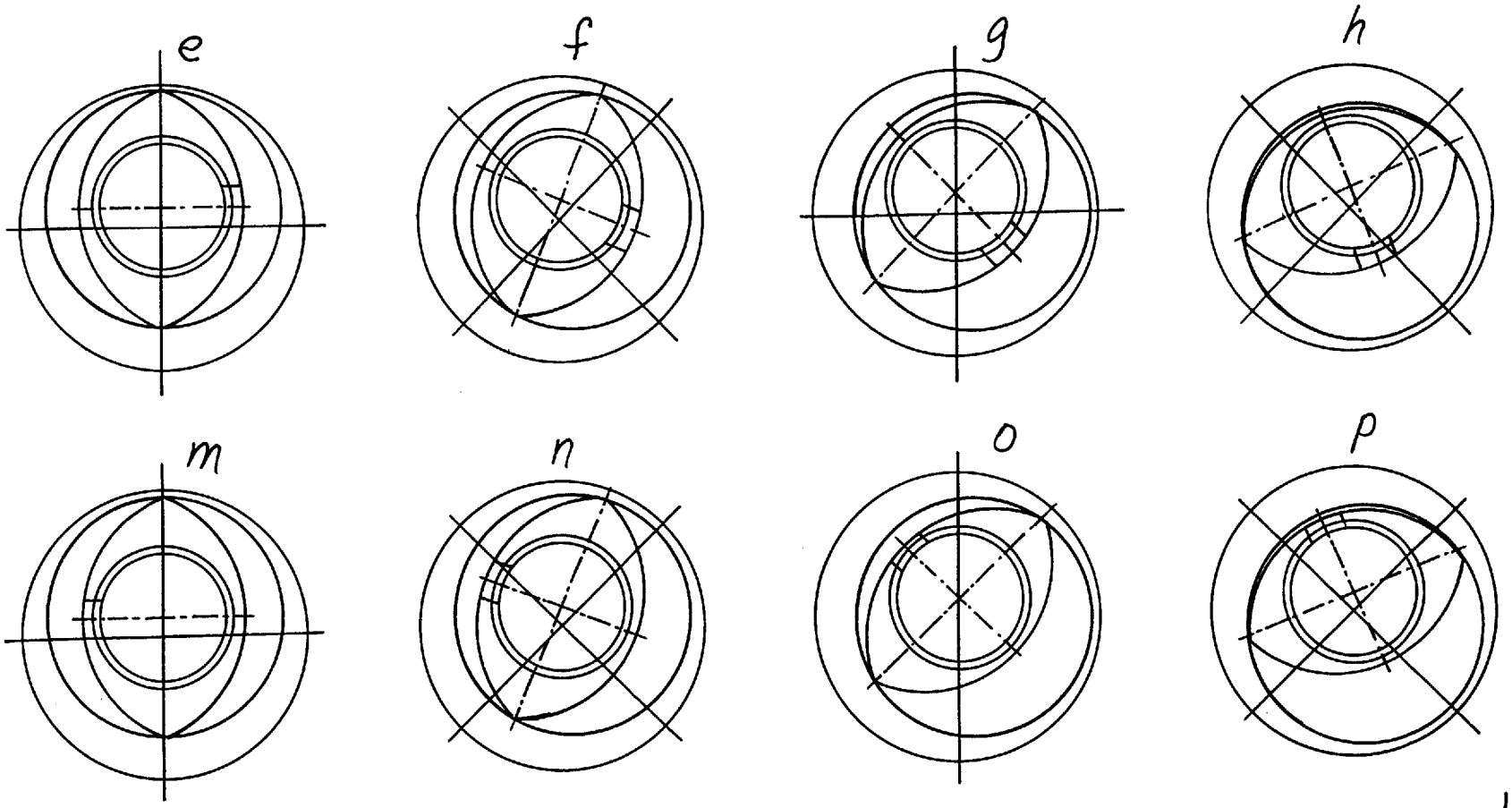
Figure 4:
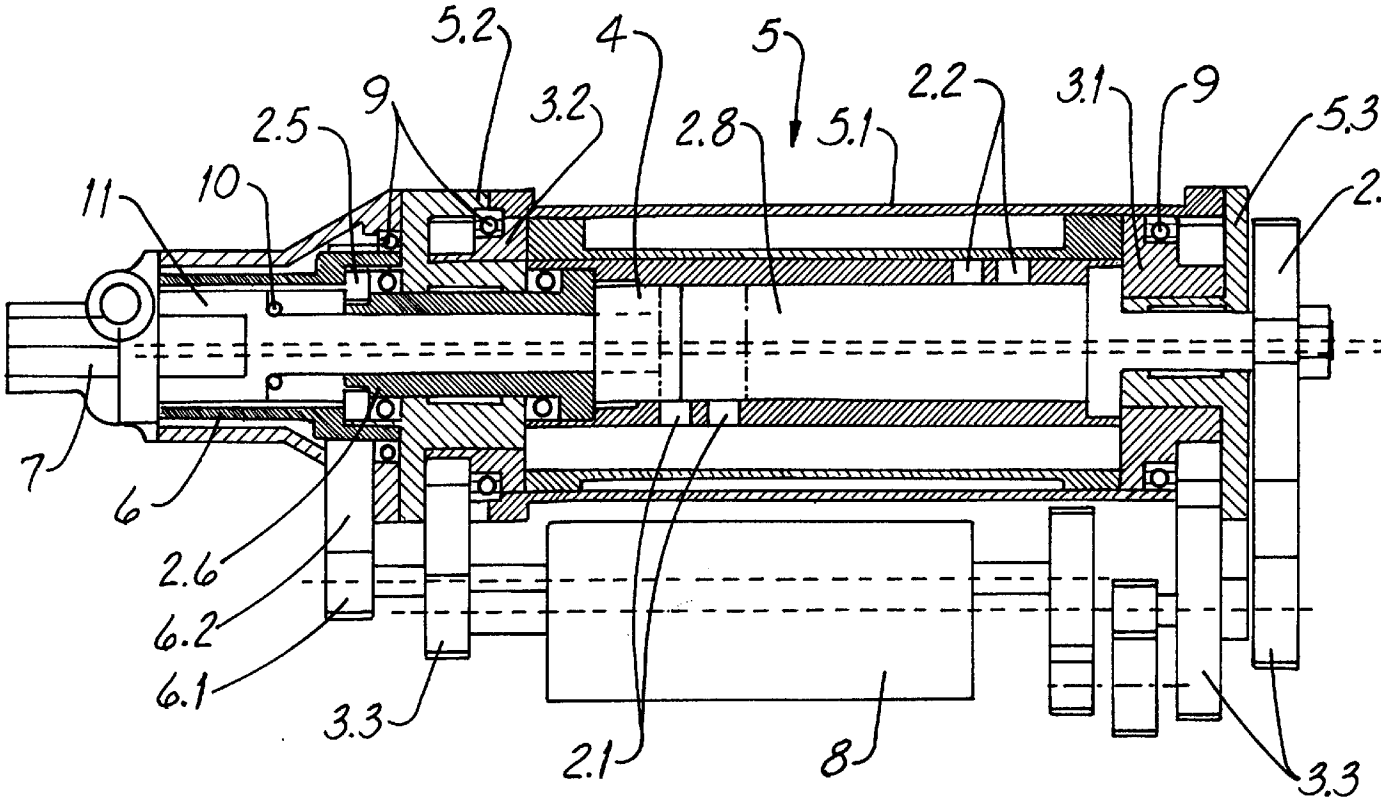

The invention is explained in more detail below by means of an exemplary embodiment with reference to the drawing. In this:

FIG. 1 shows a longitudinal section of a rotary-piston compression unit as a compressed-air floating-piston actuating unit, FIG. 2 shows a cross-section of a rotarypiston compression unit as a compressed-air floating-piston actuating unit, FIGS. 3A and B show position diagrams of the inner and outer rotor of the compressed air floating-piston actuating unit according to FIGS. 1 and 2, FIG. 4 shows a percussion drilling tool in longitudinal section with a compressed-air floating-piston actuating unit according to FIGS. 1 to 3, and FIG. 5 shows a cross-section of the compressed-air floating-piston actuating unit in the percussion drilling tool according to FIG. 4.

The basic design of an apparatus and the mode of operation for generating the compressed air by means of a rotary-piston compression unit 12 and the actuation of a floating piston 4 of a percussion appliance, such as, for example, a percussion drilling tool or a percussion chisel, are illustrated in FIGS. 1 to 3.

FIG. 1 shows the rotary-piston compression unit 1 as a compressed-air floating-piston actuating unit with an outer rotor 3 which has an eccentrically arranged inner space 3.4 with a cross-section uniform over its entire longitudinal extension and in the present case elliptic, in which an inner rotor 2 is received. The inner rotor 2 has, for example, a cylindrical cavity 2.8, in which the floating piston 4 is guided so as to be reciprocatingly displaceable.

Located near the two end faces of the inner rotor 2, on radially opposite sides of the latter, are one or more first (front) and further (rear) control channels in the form of control bores 2.1 and 2.2. The first control bore 2.1 located at the front end of the compressed-air floating-piston actuating unit is arranged so far removed from the front end face that, with the floating piston 4 pushed forwards completely, the cavity 2.8 between the front and the rear control bore 2.1 and 2.2. is free, with the result that an idle position is defined and an idle impact is avoided.

The outer cross-sectional contour of the inner rotor 2 has a large and a small outside diameter and is designed symmetrically relative to both of these, being composed of two identical segments of a circle, the radius of curvature of which is matched approximately to the radius of curvature of the inner space 3.4 of the outer rotor 3. The large diameter corresponds virtually to the small diameter of the inner space 3.4. The control bores 2.1 and 2.2 are arranged diametrically opposite one another in the region of the small diameter, but offset axially into the front and rear region of the inner rotor 2. If control channels other than the control bores mentioned are provided, their orifices are arranged correspondingly on the compression space and suction space.

The outer rotor 3 and the inner rotor 2 have axes of rotation 3.5 and 2.9 which are eccentric to one another and about which they rotate in the same direction, during operation, at a ratio of rotational speed of 2:1. Thus, a compression space and a suction space form alternately on the side of the first (front) and of the further (rear) control bores 2.1 and 2.2, that is to say in the region of the corresponding part faces A and B of the outer circumference of the inner rotor 2 and the confronting inner wall of the elliptic inner space 3.4. The compressed air is forced alternately into the control bore just confronting the compression space and drives the floating piston 4 in the direction of the other control bore, through which air is sucked in, with the result that the desired reciprocating movement of the floating piston is achieved. The mode of operation described can be reconstructed by means of the position diagrams a to p shown in FIG. 3.

During the return stroke of the floating piston 4, the impact is damped by an air cushion on the rear end face. The idling impact is avoided in that the floating piston 4 runs over the front control bore or front control bores 2.1, and the air can then circulate freely through the cylindrical cavity 2.8 via the control bores 2.1 and 2.2. If a plurality of front and/or rear control bores are provided, these can be distributed radially or axially, provided that the assignment to the respective part faces on the outer circumference of the inner rotor is preserved.

Even if the large outside diameter of the inner rotor 2 is slightly smaller than the smaller diameter of the inner space 3.4, a compression still sufficient for driving the floating piston 4 can be obtained. However, if a higher compression is desired, sealing means can be provided on the generated surfaces of the inner space 3.4 and inner rotor 2 which slide past one another, such sealing means being known, for example, from conventional rotating-piston machines.

The compressed-air floating-piston actuating unit or rotary-piston compression unit 12 can be produced from aluminum. It can be made wear-resistant by means of a so-called HARD-COAT coating, and, by means of a surface impregnation consisting of Teflon (PTFE), optimum dry lubrication can be achievable, when pronounced heating is prevented. Further advantages are: low weight, simple assembly, few components, small dimensions and, on account of the special form of construction, a high impact energy. The lathe-turned parts can be balanced, and the drive motor can be mounted in a vibration-damped manner, so that vibrations are suppressed in the apparatus as a whole.

The above-described preferred rotary-piston compression unit proceeds from the rotary-piston system DKM 53 ("Moon Maiden") proposed by Wankel. However, any other rotary-piston compression systems can also be used, in so far as a compression effect and suction effect are achieved alternately thereby at the radially and axially offset control bores. The cross-sectional shape of the cavity 2.8 in the inner rotor 2 does not need to be circular, but can have other geometrical shapes, such as, for example, elliptic or polygonal.

In order to achieve a pulse-like compression and suction effect, there can be provided in the rotating inner rotor 2 a stationary sleeve which is concentric relative to the axis of rotation 2.9 of the inner rotor and is fitted into the cavity 2.8 and into which are worked bores which are coordinated with the front and rear control bores 2.1 and 2.2. and which come into coincidence with the control bores whenever the highest compression or suction state is reached.

There can also be provided in the cavity 2.8 a co-rotating sleeve, in which there are corresponding bores or orifices connected to the suction space and the compression space respectively.

The apparatus described, in the form of the compressed-air floating-piston actuating unit with rotary-piston compressor 12, is especially suitable for use in electropnuematic hammer drills or percussion chisels.

Figure 5:
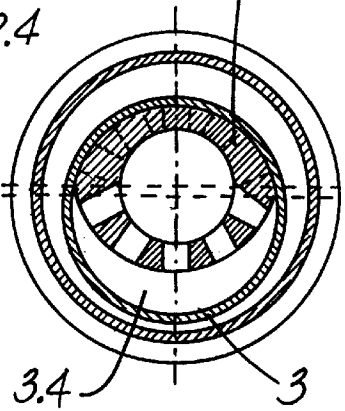

FIGS. 4 and 5 show an exemplary embodiment of a percussion appliance 1 in the form of an electro-pneumatic hammer drill.

According to FIGS. 4 and 5, the above-described floating-piston actuating unit 12 with a rotary-piston compression unit is accommodated in a guide bush 5.1 of a receiving device 5. Arranged on the guide bush 5.1 at the front and rear are a respective front and rear receptacle 5.2 and 5.3 for the outer rotor 3, in which receptacles the outer rotor 3 is mounted rotatably by means of ballbearings 9, thermal expansion being taken into account. For the drive by means of belts and belt pulleys 3.3, front and rear belt-pulley receptacles 3.1 and 3.2 are provided. Gear wheels can also be used for the drive.

A belt pulley, especially toothed-belt pulley 2.4, is likewise coupled via a shaft 2.3 to the inner rotor 2, so that the latter too can be driven from outside.

An electric motor 8, which is arranged in parallel next to the rotary-piston compression unit 12, is provided for driving the inner and the outer rotor.

A percussion pin 11 with a tool receptacle, into which a tool 7 can be inserted, is provided in the front region in a percussion-pin guide 2.6 coupled to the inner rotor 2. The percussion pin 11 is held in a drilling shaft 6 driven in rotation, which can likewise be driven by means of the electric motor 8 via a belt pulley 6.1 and a belt 6.2.

In the idle position, the percussion pin 11 is pushed completely forwards. When the tool 7 is placed on to a base, the percussion pin 11 is pushed back and, together with this, the floating piston 4 moves into the cavity between the front and rear control bores 2.1 and 2.2, so that it is driven reciprocatingly by means of the rotary-piston compressor 12. The percussion pin 11 has an O-ring 10 for softer bearing contact in the pushed-in position. Lock nuts 2.5 are screwed on behind the belt pulley 2.4 and on the percussion-pin guide.

The apparatus shown in FIG. 4 is received in a housing (not shown) which is advantageously formed from two half-shells.

A further possibility (not shown) for using the compressed-air floating-piston actuating unit with rotary-piston compressor is in a percussion chiseler, in which a percussion pin receiving the chisel is likewise present in the front region. With the exception of the rotating drive of the drilling shaft, the design corresponds essentially to the above-described hammer drill. In both tools, the percussion pin 11 and floating piston 4 are aligned axially with one another.

Further possibilities of use arise wherever axial percussion operation takes place.

I claim:

1. A percussion mechanism for a tool working by percussion or rotary percussion, said mechanism including an inner rotor and an outer rotor, said inner rotor having a cavity including axial ends, a reciprocatingly displaceable floating piston (4) guided in said cavity, at least first and second control channels (2.1, 2.2) formed in the axial ends of the inner rotor and opening respectively into the cavity (2.8) near each of its axial ends, said inner rotor (2) being rotatably mounted within said outer rotor (3), means for rotating said inner and outer rotors at different relative speeds and wherein the axes of rotation (2.9, 3.5) of the inner rotor (2) and the outer rotor (3) are arranged parallel and eccentrically to one another, said inner rotor having an outer contour and said outer rotor having an inner contour, wherein the outer contour of the inner rotor (2) and the inner contour of the outer or (3) are coordinated with one another in such a way that, during the rotation, the control channels (2.1, 2.2) located near the axial ends of the inner rotor (2) are connected alternately to a compression space and a suction space which form between the outer contour of the inner rotor (2) and the inner contour of the outer rotor (3).

2. The percussion mechanism as claimed in claim 1, wherein the outer contour of the inner rotor includes diametrically opposed part faces, the ratio of rotational speed between the inner rotor (2) and the outer rotor (3) being 1:2, and wherein the compression space and suction space are formed on diametrically opposite part faces of the outer contour of the inner rotor (2).

3. The percussion mechanism as claimed in claim 1 or 2, wherein the inner contour of the outer rotor (3) is elliptical in cross section and its central axis is offset in a parallel relation to the axis of rotation (3.5) of the outer rotor (3), and wherein the inner rotor (2) has a small and a large outside diameter to define two part faces, such that the large outside diameter virtually corresponds to the smaller inside diameter of the elliptic cross-section (3.4) of the outer rotor (3), whilst the small outside diameter is selected so that one of the two part faces (A, B) of the outer contour of the inner rotor (2) is located near the inner contour wall of the outer rotor (3) when the orientation of the small outside diameter coincides with the direction of the eccentric offset of the two axes of rotation (2.9, 3.5).

4. The percussion mechanism as claimed in claim 1 or 2, wherein the outer contour of the inner rotor (2) is symmetrical and consists of two segments of a circle.

5. The percussion mechanism as claimed in one of claim 1 or 2, wherein the cavity (2.8) of the inner rotor (2) and the floating piston (4) are cylindrical.

6. The percussion mechanism as claimed in claims 1 or 2, wherein the inner rotor includes a front end face, a percussion pin (11) provided on the front end face of the inner rotor and to which a percussion or rotary-percussion tool (7) can be coupled and which is guided for axial displacement in a 9 percussion pin guide (2.6), and wherein the percussion pin (11) is aligned axially with the floating piston (4) and is actuable by said piston.

7. The percussion mechanism as claimed in claim 6, wherein an electric motor (8) is provided for generating the rotational movement of the inner rotor (2) and of the outer rotor (3).

8. The percussion mechanism as claimed in claim 7, wherein the electric motor (8) is arranged parallel to the inner rotor (2) and outer rotor (3), and wherein the drive takes place via belt pulleys (3.3, 2.4) and belts.

9. The percussion mechanism as claimed in claim 6 and including a drive means (8), said drive means being a drilling tool (7) for rotation by the percussion pin, said drive being constructed and arranged to be coupled to and guided axially displaceably in said percussion pin guide (2.6).

10. The percussion mechanism as claimed in claim 9 and including a drilling shaft, the percussion pin (11) being held for rotation in said drilling shaft (6).

11. The percussion mechanism as claimed in claim 10 and including an electric motor, the drilling shaft (6) being coupled to said electric motor (8).

12. The percussion mechanism as claimed in claim 10 wherein said percussion pin being constructed and arranged for receiving a chisel and for guiding said chisel for axial displacement.

13. A method for actuating a percussion drilling tool or chisel of a hammer, drill, or chisel hammer comprising the steps of:

providing an elongate outer rotor having a space defined by an inner circumferential wall and an elongate inner rotor disposed in the space and having an outer surface, a pair of part faces formed on the outer surface and each conforming to a part of the inner circumferential wall, and a floating piston reciprocatingly mounted in an axially directed cavity formed in the inner rotor, rotating the outer rotor about a first axis of rotation and at a first relative speed, rotating the inner rotor in the same direction as the outer rotor and about a second axis of rotation eccentric relative to the first axis and at a different relative speed, generating compressed air in a compression space and a suction space alternately formed as a result of the rotation between the part faces of the inner rotor and inner wall of the outer rotor wherein the compression space is produced on one part face and the suction space is produced on the other part face, forcing air into the axially directed cavity inside the inner rotor from the compression space and through at least one first control channel located in the outer surface of the inner rotor near one axial end, and sucking air into the suction space of the cavity through at least one further control channel located in the outer surface at a position which is radially offset relative to the first control channel, whereby the floating piston is moved reciprocatingly between the first and second control channels.

14. The method as claimed in claim 13, including the step of rotating the inner rotor (2) and outer rotor (3) at a ratio of rotational speed or 1:2, and forming the compression space and the suction space on diametrically opposite part faces (A, B) of the outer circumference of the inner rotor (2).

15. The method as claimed in claim 13 or 14, including the step of driving the inner rotor (2) and outer rotor (3) electrically.

16. The method as claimed in claim 13 and including the steps of forming an air cushion downstream of at least one of said control channels for damping the return stroke of the floating piston.

17. A method for actuating a percussion tool comprising the steps of:

providing an elongate outer rotor having a space defined by an inner circumferential wall and an elongate inner rotor disposed in the space and having a pair of faces each conforming to a part of the inner circumferential wall, and a floating piston reciprocatingly mounted in an axially directed cavity formed in the inner rotor, rotating the outer rotor about a first axis of rotation and at a first relative speed, rotating the inner rotor in the same direction as the outer rotor and about a second axis of rotation eccentric relative to the first axis and at a different relative speed, alternately forming a compression space and a suction space as a result of the rotation between the faces of the inner rotor and inner wall of the outer rotor wherein the compression space is produced on one face and the suction space is produced on the other face, generating compressed air in said compression space, conducting the compressed air into the cavity inside the inner rotor from the compression space and through a first control channel located in inner rotor, and sucking air into the suction space out of the cavity through a second control channel located in the inner rotor and spaced from the first channel, whereby the floating piston is moved reciprocatingly between the first and second control channels.

18. The method as claimed in claim 17, including the step of rotating the inner rotor and outer rotor at a ratio of rotational speed of 1:2, and forming the compression space and the suction space on diametrically opposite faces of the outer circumference of the inner rotor.

19. A percussion mechanism for a percussion tool, said mechanism including an outer rotor having a first cavity formed therein, an inner rotor rotatably mounted in the first cavity and having a second cavity formed therein, a reciprocatingly displaceable floating piston guided in said second cavity, first and second spaced apart control openings communicating respectively with the second cavity, means for rotating said inner and outer rotors at different relative speeds and wherein the axes of rotation of the inner rotor and the outer rotor are arranged parallel and eccentrically to one another, said inner rotor having an outer contour and the cavity in said outer rotor having an inner contour, wherein the outer contour of the inner rotor and the inner contour of the outer rotor are coordinated with one another in such a way that, during the rotation, the spaced control openings are connected alternately to a compression space and a suction space which form between the outer contour of the inner rotor and the inner contour of the outer rotor.

20. The percussion mechanism as claimed in claim 19, wherein the outer contour of the inner rotor includes diametrically opposed part faces, the ratio of rotational speed between the inner rotor and the outer rotor being 1:2, and wherein the compression space and suction space are formed on diametrically opposite faces of the outer contour of the inner rotor.

* * * * *

UNITED STATES PATENT AND TRADEMARK OFFICE

CERTIFICATE OF CORRECTION

PATENT NO. : 5,769,620

DATED : June 23, 1998

INVENTOR(S) : Rolf Briem

It is certified that error appears in the above-identified patent and that said Letters Patent is hereby corrected as shown below:

Column 2, line 4 insert --a-- before "tool".

Column 3, line 24, after "and" begin a new paragraph.

Column 6, line 39 delete "9".

Signed and Sealed this

Twenty-second Day of September, 1998

*Attest:*

Bruce Lehman

BRUCE LEHMAN

*Attesting Officer*

*Commissioner of Patents and Trademarks*